US005213446A

United States Patent [19]

Dovan

[11] Patent Number: 5,213,446

[45] Date of Patent: May 25, 1993

[54] DRILLING MUD DISPOSAL TECHNIQUE

[75] Inventor: Hoai T. Dovan, Yorba Linda, Calif.

[73] Assignee: Union Oil Company of California, Los Angeles, Calif.

[21] Appl. No.: 649,765

[22] Filed: Jan. 31, 1991

[51] Int. Cl.[5] ..... E21B 21/06

[52] U.S. Cl. ..... 405/128; 166/305.1; 166/295; 175/66; 175/206

[58] Field of Search ..... 405/128, 129, 258; 166/308, 305 D, 295, 294; 175/66, 206

[56] References Cited

U.S. PATENT DOCUMENTS

| | | | |
|---|---|---|---|
| 3,606,925 | 9/1971 | Poettmann | 166/305 D |
| 3,712,593 | 3/1973 | Poettmann | 166/305 D |
| 3,724,542 | 4/1973 | Hamilton | 166/308 X |
| 3,841,402 | 10/1974 | Knight et al. | 166/308 X |
| 3,881,552 | 5/1975 | Hessert | 166/281 X |
| 3,909,423 | 9/1975 | Hessert et al. | 252/8.55 |
| 4,040,484 | 8/1977 | Hessert | 166/294 |
| 4,091,868 | 5/1978 | Kozlowski et al. | 166/281 X |
| 4,238,374 | 12/1980 | Durham et al. | 260/17.4 |
| 4,428,427 | 1/1984 | Friedman | 166/295 X |
| 4,429,746 | 2/1984 | Allard | 166/291 |
| 4,460,292 | 7/1984 | Durham et al. | 405/129 |
| 4,494,606 | 1/1985 | Sydansk | 166/295 |
| 4,507,208 | 3/1985 | Simon et al. | 210/721 |
| 4,534,412 | 8/1985 | Dovan et al. | 166/295 |
| 4,547,298 | 10/1985 | Novak | 166/295 X |
| 4,668,128 | 5/1987 | Hartley et al. | 405/266 |
| 4,683,949 | 8/1987 | Sydansk et al. | 166/270 |
| 4,693,310 | 9/1987 | Gibbons | 166/270 |
| 4,706,754 | 11/1987 | Smith | 166/295 |
| 4,723,605 | 2/1988 | Sydansk | 166/295 |
| 4,730,675 | 3/1988 | Wygant et al. | 166/295 |
| 4,732,213 | 3/1988 | Bennett et al. | 166/292 |
| 4,776,398 | 10/1988 | Chu et al. | 166/295 X |
| 4,781,860 | 11/1988 | Doan | 405/129 X |
| 4,926,943 | 5/1990 | Hoskin | 166/295 X |
| 4,942,929 | 7/1990 | Malachosky et al. | 175/206 X |
| 5,109,933 | 5/1992 | Jackson | 405/128 X |
| 5,129,469 | 7/1992 | Jackson | 405/128 X |

*Primary Examiner*—Dennis L. Taylor

*Attorney, Agent, or Firm*—Gregory F. Wirzbicki; Shlomo R. Frieman

[57] ABSTRACT

Drilling mud is economically disposed of in an environmentally sound manner by mixing the mud with a crosslinkable polymer and a crosslinking agent to form a composition that solidifies at a predetermined time. The composition is injected into a subterranean formation through an abandoned well and, when solidified, is substantially immobilized within the formation.

20 Claims, No Drawings

DRILLING MUD DISPOSAL TECHNIQUE

BACKGROUND

The present invention relates to a method for disposing of drilling muds and to a disposable drilling mud composition.

The disposal of drilling muds can be costly. An exemplary expensive disposal technique entails hauling the drilling mud to a landfill. In a less expensive disposal technique, the drilling mud is injected into a subterranean formation of an abandoned drilled well after the drilling operation is terminated. However, because of increasing environmental awareness the latter technique may possess latent problems since the injected drilling mud remains mobile in the subterranean formation and can potentially migrate to more environmentally sensitive portions, e.g., potable water aquifers, of the formation.

SUMMARY OF THE INVENTION

The present invention provides an environmentally sound drilling mud disposal injection process wherein the injected drilling mud is immobilized in the subterranean formation. Specifically, the process entails mixing a drilling mud with a crosslinkable polymer and a crosslinking agent to form a composition and injecting the composition into a subterranean formation of an abandoned well. The injected composition is rendered immobile within the formation at a predetermined time interval after being injected and is capable of achieving a hardness of less than about 280 penetrometer units as measured by ASTM D 217 - 88 Standard Test Methods for Cone Penetration of Lubricating Grease with one modification, namely, using a ¼ scale penetrometer, i.e., a Precision brand penetrometer with 1/10 mm divisions, manufactured by Precision Scientific Co., Chicago, Ill. (The lower the penetrometer unit reading, the harder the material being measured.)

In addition to the drilling mud disposal process, the invention also encompasses a disposable drilling mud and a drilling mud disposal system. The disposable drilling mud is substantially devoid of inert non-packing, highly porous water-trapping, aggregate particles and comprises a drilling mud, a crosslinkable polymer, and a crosslinking agent. As used in the specification and claims, the phrase "inert, non-packing, highly porous, water-trapping, aggregate particles" means particles capable of holding at least about 4 grams of water per gram of particles and having a surface area of at least about 10 square meters per gram and an apparent bulk density of not over about 30 pounds per square foot. Exemplary inert, non-packing, highly porous, water-trapping, aggregate particles include, but are not limited to biogenetic silica as described in U.S. Pat. No. 4,460,292 (which is incorporated herein in its entirety by reference), rice hull ash, ground silica gel, ground aluminum hydrogel, silica alumina cracking catalyst, expanded mica, expanded perlite, aluminum oxide, and silica oxide.

The drilling mud disposal system of the present invention comprises a subterranean formation, a well penetrating at least a portion of the formation, the well having an interior bore and a port in fluid communication with the formation and the interior bore, and a solidified drilling mud located in at least a portion of the interior bore and/or at least a portion of the formation. The solidified drilling mud comprises a drilling mud and about 0.05 to about 50 weight percent of a crosslinked polymer.

DETAILED DESCRIPTION OF THE INVENTION

In the drilling mud disposal process of the present invention, a drilling mud is combined with a crosslinkable polymer and a crosslinking agent to form a composition which solidifies at a predetermined time. The crosslinkable polymer employed with a water-based mud is preferably water-soluble, whereas an oil-soluble polymer is preferably used with an oil-based mud.

Common classes of water soluble crosslinkable polymers include polyvinyl polymers, polymethacrylamides, cellulose ethers, polysaccharides, lignosulfonates, ammonium salts thereof, alkali metal salts thereof, as well as alkaline earth salts of lignosulfonates. Specific examples of typical water soluble polymers are acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyvinyl acetate, polyvinyl pyrrolidone, polyalkyleneoxides, carboxycelluloses, carboxyalkylhydroxyethyl celluloses, hydroxyethylcellulose, galactomannans (e.g., guar gum), substituted galactomannans (e.g., hydroxypropyl guar), heteropolysaccharides obtained by the fermentation of starch-derived sugar (e.g., xanthan gum), and ammonium and alkali metal salts thereof. Preferred water soluble crosslinkable polymers include hydroxypropyl guar, partially hydrolyzed polyacrylamides, xanthan gum, polyvinyl alcohol, and the ammonium and alkali metal salts thereof. The weight average molecular weight of these polymers is about 10,000 to about 50,000,000, preferably about 100,000 to about 20,000,000, and most preferably about 200,000 to about 15,000,000.

Exemplary oil-soluble, crosslinkable polymers are polyvinyl chloride, polyethylene, polypropylene, and polystyrene. The number average molecular weight of the oil-soluble, crosslinkable polymers is generally at least about 100,000 and preferably at least about 250,000.

With respect to the crosslinking agents, these agents are organic and inorganic compounds well known to those skilled in the art. Representative organic crosslinking agents include, but are not limited to, aldehydes, dialdehydes, phenols, substituted phenols, and ethers. Phenol, resorcinol, glutaraldehyde, catechol, formaldehyde, and divinylether are some of the more typical organic crosslinking agents. Typical inorganic crosslinking agents are polyvalent metals, chelated polyvalent metals, and compounds capable of yielding polyvalent metals. Some of the more common inorganic crosslinking agents include chromium salts, aluminates, gallates, dichromates, titanium chelates, aluminum citrate, chromium citrate, chromium acetate, and chromium propionate. The oil-soluble, crosslinkable polymers are crosslinked with organic crosslinking agents and the water-soluble polymers are crosslinked with either organic or inorganic crosslinking agents.

Preferably, sufficient amounts of crosslinkable polymer and crosslinking agent are mixed with the drilling mud to form a resulting composition capable of achieving a hardness of less than about 280 penetrometer units. As used in the specification and claims, the penetrometer units are measured according to a modified version of a procedure entitled Standard Test Methods for Cone Penetration of Lubricating Grease and having the ASTM designation of D 217 - 88, ASTM D 217 - 88 being incorporated herein in its entirety by reference. The sole modification entails the use of a ¼ scale penetrometer, i.e., a Precision brand penetrometer with 1/10 mm divisions, manufactured by Precision Scientific Co., Chicago, Ill. More preferably, the resulting composition is capable of achieving a hardness of less than 200 penetrometer unit, and most preferably less than 150 penetrometer units.

Generally, the amounts of crosslinkable polymer and crosslinking agent added to the drilling mud are sufficient for the resulting composition to form a gel. Preferably, the concentration of the crosslinkable polymer in the drilling mud is about 0.05 to about 50 weight percent, more preferably about 0.1 to about 10 weight percent, and most preferably about 0.3 to about 2 weight percent. The crosslinking agent concentration in the drilling mud is preferably about 0.001 to about 5 weight percent, more preferably about 0.01 to about 1 weight percent, and most preferably about 0.02 to about 0.5 weight percent.

To further aid in controlling the solidifying time of the drilling mud, a crosslinking reaction regulator is optionally also added to the drilling mud to form the solidifiable, disposable drilling mud composition. Exemplary crosslinking reaction regulators include (a) reducing agents capable of activating the crosslinking agent, (b) sequestering agents capable of (i) inhibiting the activity of the crosslinking agent and (ii) releasing the crosslinking agent to the polymer at known conditions, e.g., subterranean formation conditions, to enable the crosslinking agent to crosslink the polymer, and (c) pH modifiers capable of degrading at known conditions to adjust the pH of the crosslinking agent-containing drilling mud to within a pH range wherein the crosslinking agent crosslinks with the crosslinkable polymer. Typical reducing agents are sulfur-containing compounds such as sodium sulfite, sodium hydrosulfite, sodium metabisulfite, potassium metabisulfite, sodium sulfide, sodium thiosulfate, ferrous sulfate, thioacetamide, and hydrogen sulfide; non-sulfur containing compounds such as hydroquinone, ferrous chloride, p-hydrazinobenzoic acid, hydrazine phosphite, hydrazine dichloride, manganese chloride, potassium iodide, potassium ferrocyanide, and manganese nitrate. As a general rule, the concentration of reducing agent is preferably about 0.1 to about 300, preferably about 10 to about 200, and more preferably about 50 to about 150 weight percent of the stoichiometric concentration required to reduce the metal in the starting polyvalent metal component to the lower polyvalent state as detailed in U.S. Pat. No. 3,909,423 and U.S. Pat. No. 4,040,484, which patents are incorporated herein in their entirety by reference.

With respect to sequestering agents, exemplary sequestering agents include, but are not limited to, citrate, propionate, and acetate salts of polyvalent metal ions (such as aluminum, chromium, and iron). Generally, when the sequestering agents are used, the stoichiometric ratio of the sequestering agents to the crosslinking agents is at least about 1:1 and preferably within the range of about 1:1 to about 3:1. In terms of weight percent, the concentration of sequestering agent, when present in the solidifiable, disposable drilling mud composition, is typically about 0.05 to about 20 weight percent, and preferably about 0.2 to about 5 weight percent.

Regarding pH modifying agents, these agents include acid precursors and base precursors, which generally either hydrolyze or thermally decompose to form an acid or a base, respectively. Typical classes of acid precursors include hydrolyzable esters, acid anhydrides, sulfonates, organic halides, and salts of a strong acid and a weak base. Exemplary specific acid precursors are ethyl formate, propyl formate, ethyl acetate, glycerol monoacetate, acetin, glycerol diacetate, diacetin, xanthanes, thiocyanates, polyethylene esters, ethyl acetate esters, acrylate copolymers, and dimethyl esters. Ethyl formate, propyl formate, ethyl acetate, dibasic esters, and their mixtures are the preferred acid precursors. The more widely known base precursor classes are ammonium salts, quaternary ammonium salts, urea, substituted ureas, coordinated compounds, and salts of a strong base and a weak acid, with the preferred base precursors being urea, thiourea, ammonium chloride, and mixtures thereof. The pH modifying agent, when employed, is usually present in the solidifiable, disposable drilling mud composition in a concentration of about 0.05 to about 20 weight percent, and preferably in a concentration of about 0.2 to about 5 weight percent.

In contrast to the modified drilling mud of U.S. Pat. No. 4,460,292, the disposable drilling mud of the present invention does not require the presence of biogenetic silica or any other inert non-packing, highly porous water-trapping, aggregate particles. Accordingly, the present invention's disposable drilling mud is preferably substantially devoid of biogenetic silica and any other inert non-packing, highly porous water-trapping, aggregate particles.

After the crosslinkable polymer, the crosslinking agent, and any optional ingredients are mixed with the drilling mud, the resulting solidifiable, disposable drilling mud composition is injected into a subterranean formation. The injection pressure is sufficient to displace the composition into the formation. Typically, the injection pressure exceeds the pressure necessary to fracture the formation (formation fracture limit pressure). The formation fracture limit pressure varies from formation to formation and is generally empirically determined by techniques known to those skilled in the art.

Usually, the composition is injected into the formation through a well that penetrates at least a portion of the formation. More specifically, the composition is injected into the interior bore of the well, passes down the well bore, and out at least one port in the well that is in fluid communication with the formation and the interior bore. After a predetermined time, the composition solidifies and occupies a substantially fixed portion of the formation. Because the drilling mud is immobilized in the formation, adverse potential environmental risks due to the migration of the mud into other parts of the formation, such as potable water aquifers, is substantially reduced, if not totally eliminated.

EXAMPLES

In the following examples, an actual laboratory experiment is described and two exemplary field embodiments are discussed. These examples illustrate, and do not limit, the invention.

EXAMPLE 1

Laboratory Experiment

Two different drilling muds were synthetically prepared in the laboratory for testing. These muds and their compositions are shown in the following Table 1:

TABLE 1

| Chemical | Concentration, lbs/bbl Mud A[a] | Mud B[b] |
|---|---|---|
| P-95[c] | 15.0 | 15.0 |
| Bentonite[d] | 15.0 | 20.0 |
| KOH | 0.5 | 1.25 |
| Drispac[e] | 1.0 | 0.25 |
| K-160[f] | 4.0 | — |
| Gelite[g] | 10.0 | — |
| Sea Salt | 14.7 | — |
| I-100[h] | — | 3.0 |
| Morrex[i] | — | 2.0 |
| Ligco[j] | — | 1.0 |
| Lime | — | 4.0 |

[a]Mud A is a Drispac drilling mud system made using sea water and adjusted to a pH of about 10.0 with KOH.
[b]Mud B is a lime Morrex drilling mud system made using fresh water and adjusted to a pH of about 12.0 using KOH.
[c]P-95 are UNOCAL brand simulated drill cuttings.
[d]The bentonite used was obtained from the Baroid Drilling Fluids Co.
[e]Drispac is a Drilling Specialties Co. brand polyanionic cellulose.
[f]K-160 is a MI Drilling Fluids Co. brand sodium lignite salt.
[g]Gelite is a MI Drilling Fluids Co. brand saponite clay.
[h]I-100 is a MI Drilling Fluids Co. brand starch.
[i]Morrex is a Milpark Drilling Fluids Co. brand low molecular weight polymer.
[j]Ligco is a Milchem Co. brand lignite.

After measuring about 100 grams of each drilling mud into separate beakers, the beakers were put on mixers with caged impellers. Nalflo 3857 brand polyacrylamide polymer (an emulsion that is about 35.3 weight percent active) was then added to each beaker and mixed with the drilling muds—the polymer concentration in each drilling mud being about 5000 ppm.

The polymer/drilling mud mixtures were next put into vials with each vial containing about 15 cc of one of the mixtures (approximately 17 grams). Varying amounts of crosslinker (potassium dichromate) and reducing agent (sodium thiosulfate) were subsequently added to the vials. The weight ratio of reducing agent:crosslinker was kept constant at about 3:1. Because the reducing agent and the crosslinker were both supplied in solid granular form, 10 weight percent solutions of each were made and the resulting solutions were added to each of the polymer/drilling mud mixtures to form solidifiable, disposable drilling mud compositions having a polymer concentration of about 4000 ppm.

The vials were shaken to thoroughly mix all the chemicals together and then placed in an oven that was preheated to about 110° F. The compositions were periodically inspected for gel quality and then returned to the oven to continue the aging process.

The results of the gel tests are presented below in Tables 2–3. As detailed in the footnotes to Table 2, the quality of the gels was rated both quantitatively using a ¼-scale modified ASTM D 217 - 88 standardized test method and qualitatively.

TABLE 2

Penetrometer Readings of Drilling Mud A Containing 4000 ppm of N-3857 Polymer Aged at 135° F.

| Dichromate ppm | Thiosulfate ppm | Penetrometer Reading[a] Initial | 1 hour | 1 day |
|---|---|---|---|---|
| 0 | 0 | offscale[b] | offscale | offscale |
| 250 | 750 | offscale | offscale | offscale |
| 500 | 1500 | offscale | offscale | offscale |
| 1000 | 3000 | offscale | offscale | 215 (2)[c] |
| 2000 | 6000 | offscale | offscale | 155 (3−) |
| 3000 | 9000 | offscale | offscale | 142 (3) |

[a]Using a quarter-scale apparatus.
[b]Offscale >285.
[c]Numbers in parentheses denote subjective gel ratings with the offscale readings being equivalent to a (1) on the subjective scale.
Subjective Gel Rating Scale
1 Watery
2 High Viscosity
3 Weak Gel
4 Elastic Gel
5 Stiff Gel
[d]N/T denotes no reading taken.

TABLE 3

Penetrometer Readings of Drilling Mud B Containing 4000 ppm of N-3857 Polymer Aged at 135° F.

| Dichromate ppm | Thiosulfate ppm | Penetrometer Reading[a] Initial | 1 hour | 1 day |
|---|---|---|---|---|
| I0 | 0 | offscale[b] | 162 (2+)[c] | N/T[d] |
| 250 | 750 | offscale | N/T | 94 (5−) |
| 500 | 1500 | offscale | 141 (3) | N/T |
| 1000 | 3000 | offscale | N/T | 91 (5−) |
| 2000 | 6000 | offscale | 128 (3+) | 76 (5) |
| 4000 | 12000 | offscale | 111 (4) | N/T |

[a]See footnote a of Table 2, supa.
[b]See footnote b of Table 2, supra.
[c]See footnote c of Table 2, supra.
[d]See footnote d of Table 2, supra.

The results set forth in Tables 2–3 show that the hardness of the resulting gel varies depending upon the concentrations of the crosslinking and reducing agents. In addition, the results indicate that gel times can be delayed from about one hour to about one day or more.

EXAMPLE 2

Field Applications

Exemplary field applications of the present invention include injecting gelable drilling muds into abandoned wells in a batch mode or continuously "on the fly." In a typical batch mode, batches of drilling mud (about 10 to about 20 barrels per batch) are mixed in a large tank with a polymer (supplied in a liquid or solid form) and a crosslinking agent and then injected into a well. The drilling mud, the polymer, and the crosslinking agent are thoroughly mixed in the large tank using either rotors, impellers, or constant recirculation with centrifugal pumps. In one particular batch mode version, two large tanks are used to achieve a quasi-continuous process. Specifically, while a gelable drilling mud is being prepared in one tank, a previously prepared gelable drilling mud is injected into the subterranean formation from the other tank.

To inject gelable drilling muds "on the fly", one dedicated pump is used for each added chemical. While the main injection pump transports the drilling mud through a main injection line from the drilling mud pit for injection into the disposal well, another pump injects a liquid polymer into the main injection line. The polymer and drilling mud are then mixed in the main injection line using an in-line mixer, e.g., a Komax brand motionless mixer.

Another metering pump is employed to inject a crosslinking agent into the main injection line downstream from where the polymer is added. The drilling mud, the polymer, and the crosslinking agent then go through another in-line mixer before being injected into the well. Because all the chemicals are injected into the main injection line "on the fly", all the chemicals are preferably used in a liquid form so that they are readily pumpable.

Although the present invention has been described in considerable detail with reference to some preferred versions, other versions are possible. For example, other crosslinkable polymers, crosslinking agents, and crosslinking reaction modifiers, in addition to those discussed above, can be employed in the drilling mud disposal procedure of the present invention. Furthermore, instead of being used to form disposable mud compositions, the process of the present invention can be employed to form disposable slurry and other disposable mud compositions. An exemplary slurry is a brine slurry by-product of geothermal steam production. Other examples of muds include muds from industrial evaporation ponds and flocculated by-products of water treatment plants. The same concentrations of crosslinkable polymers, crosslinking agents, and optional additives employed to form disposable drilling mud compositions are used to form disposable slurry and other disposable mud compositions. Accordingly, as used in the claims, the term "slurry" is used to collectively denote drilling muds, brine slurries, muds from industrial evaporation ponds, and flocculated by-products of water treatment plants. Therefore, the spirit and scope of the appended claims should not necessarily be limited to the description of the preferred versions contained herein.

What is claimed is:

1. A disposable slurry comprising:

(a) a slurry selected from the group consisting of water-based drilling muds, brine slurries, muds from industrial evaporation ponds, and flocculated by-products of water treatment ponds;

(b) a water-soluble crosslinkable polymer; and (c) a crosslinking agent, wherein the slurry is substantially devoid of inert non-packing, highly porous water-trapping, aggregate particles.

2. The slurry of claim 1 further comprising a crosslinking reaction regulator.

3. The slurry of claim 1 comprising about 0.05 to about 50 weight percent crosslinkable polymer.

4. The slurry of claim 1 comprising about 0.1 to about 10 weight percent crosslinkable polymer.

5. The slurry of claim 1 comprising about 0.001 to about 5 weight percent crosslinking agent.

6. The slurry of claim 1 comprising about 0.01 to about 1 weight percent crosslinking agent.

7. The disposable slurry of claim 1 wherein the slurry comprises a water-based drilling mud.

8. The disposable slurry of claim 1 wherein the slurry comprises a brine slurry.

9. The disposable slurry of claim 1 wherein the slurry comprises a mud from an industrial evaporation pond.

10. The disposable slurry of claim 1 wherein the slurry comprises a flocculated by-product of a water treatment pond.

11. The disposable slurry of claim 1 wherein the slurry comprises a water-based drilling mud and the crosslinking agent is selected from the group consisting of aldehydes, dialdehydes, phenols, substituted phenols, ethers, aluminates, gallates, titanium chelates, aluminum citrate, chromium citrate, chromium acetate, and chromium propionate.

12. The disposable slurry of claim 1 wherein the slurry comprises a water-based drilling mud and the crosslinking agent is selected from the group consisting of aldehydes, dialdehydes, phenols, substituted phenols, and ethers.

13. The disposable slurry of claim 1 wherein the slurry comprises a water-based drilling mud and the crosslinking agent is selected from the group consisting of aluminates, gallates, titanium chelates, aluminum citrate, chromium citrate, chromium acetate, and chromium propionate.

14. The disposable slurry of claim 1 wherein the crosslinking agent is selected from the group consisting of aldehydes, dialdehydes, phenols, substituted phenols, ethers, aluminates, gallates, titanium chelates, aluminum citrate, chromium citrate, chromium acetate, and chromium propionate.

15. The disposable slurry of claim 1 wherein the crosslinking agent is selected from the group consisting of aldehydes, dialdehydes, phenols, substituted phenols, and ethers.

16. The disposable slurry of claim 1 wherein the crosslinking agent is selected from the group consisting of aluminates, gallates, titanium chelates, aluminum citrate, chromium citrate, chromium acetate, and chromium propionate.

17. The disposable slurry of claim 1 wherein the disposable slurry comprises sufficient concentrations of (a) the crosslinkable polymer and (b) the crosslinking agent selected from the group consisting of aldehydes, dialdehydes, phenols, substituted phenols, ethers, aluminates, gallates, titanium chelates, aluminum citrate, chromium citrate, chromium acetate, and chromium propionate for the disposable slurry to be capable of achieving a hardness of less than about 280 penetrometer units.

18. The disposable slurry of claim 1 wherein the disposable slurry comprises sufficient concentrations of (a) the crosslinkable polymer and (b) the crosslinking agent selected from the group consisting of aldehydes, dialdehydes, phenols, substituted phenols, and ethers for the disposable slurry to be capable of achieving a hardness of less than about 280 penetrometer units.

19. The disposable slurry of claim 1 wherein the disposable slurry comprises sufficient concentrations of (a) the crosslinkable polymer and (b) the crosslinking agent selected from the group consisting of phenol, resorcinol, glutaraldehyde, catechol, formaldehyde, divinylether, aluminates, gallates, titanium chelates, aluminum citrate, chromium citrate, chromium acetate, and chromium propionate for the disposable slurry to be capable of achieving a hardness of less than about 280 penetrometer units.

20. A slurry comprising:

(a) a water-based drilling mud;

(b) a water-soluble crosslinkable polymer; and (c) a crosslinking agent, wherein the slurry is devoid of inert, non-packing, highly porous, water-trapping, aggregate particles.

* * * * *

UNITED STATES PATENT AND TRADEMARK OFFICE

CERTIFICATE OF CORRECTION

PATENT NO. : 5,213,446

DATED : May 25, 1993

INVENTOR(S) : Hoai T. Dovan

It is certified that error appears in the above-identified patent and that said Letters Patent is hereby corrected as shown below: On the title page, Item

[56] References Cited

U.S. PATENT DOCUMENTS

Replace "3,712,593" with -- 3,722,593 --.

Signed and Sealed this

Eighteenth Day of January, 1994

Attest:

Bruce Lehman

BRUCE LEHMAN

Attesting Officer

Commissioner of Patents and Trademarks